US010767246B2

(12) United States Patent
Mourer et al.

(10) Patent No.: US 10,767,246 B2
(45) Date of Patent: Sep. 8, 2020

(54) ENHANCED SUPERALLOYS BY ZIRCONIUM ADDITION

(71) Applicant: GENERAL ELECTRIC COMPANY, Schenectady, NY (US)

(72) Inventors: David Paul Mourer, Lynn, MA (US); Andrew Ezekiel Wessman, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 332 days.

(21) Appl. No.: 15/504,777

(22) PCT Filed: Aug. 17, 2015

(86) PCT No.: PCT/US2015/045547
§ 371 (c)(1),
(2) Date: Feb. 17, 2017

(87) PCT Pub. No.: WO2016/053489
PCT Pub. Date: Apr. 7, 2016

(65) Prior Publication Data

US 2018/0223395 A1 Aug. 9, 2018

Related U.S. Application Data

(60) Provisional application No. 62/038,416, filed on Aug. 18, 2014.

(51) Int. Cl.
*C22C 19/05* (2006.01)
*F01D 5/02* (2006.01)
(Continued)

(52) U.S. Cl.
CPC ..... *C22C 19/056* (2013.01); *F01D 5/02* (2013.01); *F01D 25/005* (2013.01);
(Continued)

(58) Field of Classification Search
CPC ..... C22C 19/056; C22C 19/057; C22F 1/10
See application file for complete search history.

(56) References Cited

U.S. PATENT DOCUMENTS 3,759,707 A * 9/1973 Hockin et al. ..... C22C 19/056 420/448
4,878,965 A 11/1989 Gostic et al.
(Continued)

FOREIGN PATENT DOCUMENTS

CN 102851633 A 1/2013
CN 102851633 A 1/2013
(Continued)

OTHER PUBLICATIONS

I. Choudhury, M. El-Baradie, Machinability of nickel-base super alloys: a general review. J Mater Process Technol, 77 (1998), pp. 278-284.*

(Continued)

*Primary Examiner* — Jessee R Roe
(74) *Attorney, Agent, or Firm* — Dority & Manning, P.A.

(57) ABSTRACT

A gamma prime nickel-based superalloy is provided, which can include a combination of Ti and Zr in a total weight amount sufficient to form cellular precipitates located at grain boundaries of the alloy, wherein the cellular precipitates define gamma prime arms that distort the grain boundaries at which they are located. The Hf-containing, gamma prime nickel-based superalloy and/or the gamma prime nickel-based superalloy can include cellular precipitates that are predominantly located at grain boundaries of the alloy such that the cellular precipitates define gamma prime arms that distort the grain boundaries at which they are located. The superalloys can further include finer gamma prime precipitates (e.g., cuboidal or spherical precipitates) than the cellular precipitates.

21 Claims, 2 Drawing Sheets

(51) Int. Cl.
*F01D 25/00* (2006.01)
*F01D 5/30* (2006.01)

(52) U.S. Cl.
CPC ..... *F01D 5/3007* (2013.01); *F05D 2220/32* (2013.01); *F05D 2300/175* (2013.01)

(56) References Cited

U.S. PATENT DOCUMENTS

| | | | | |
|---|---|---|---|---|
| 4,957,567 | A | 9/1990 | Krueger et al. | |
| 5,662,749 | A | 9/1997 | Chang | |
| 6,291,084 | B1 | 9/2001 | Darolia et al. | |
| 6,416,596 | B1 | 7/2002 | Wood et al. | |
| 6,428,637 | B1 | 8/2002 | Wood et al. | |
| 6,521,175 | B1 | 2/2003 | Mourer et al. | |
| 6,551,372 | B1 | 4/2003 | Ewing et al. | |
| 6,696,176 | B2 | 2/2004 | Allen et al. | |
| 6,887,589 | B2 | 5/2005 | Darolia et al. | |
| 7,326,441 | B2 | 2/2008 | Darolia et al. | |
| 7,740,724 | B2 | 6/2010 | Clemens | |
| 8,512,874 | B2 | 8/2013 | Darolia et al. | |
| 8,613,810 | B2 | 12/2013 | Mourer et al. | |
| 8,708,659 | B2 | 4/2014 | Tryon et al. | |
| 2008/0166258 | A1* | 7/2008 | Tanimoto | C22C 19/051 420/448 |
| 2011/0203707 | A1 | 8/2011 | Mourer et al. | |
| 2012/0027607 | A1* | 2/2012 | DiDomizio | C22C 19/03 416/223 R |

FOREIGN PATENT DOCUMENTS

| | | | |
|---|---|---|---|
| CN | 103451478 | A | 12/2013 |
| EP | 1 065 290 | A1 | 1/2001 |
| EP | 1 195 446 | A1 | 4/2002 |
| JP | S5023321 | A | 3/1975 |
| JP | S60100641 | A | 6/1985 |
| JP | 2007/113057 | A | 5/2007 |
| JP | 2008/075171 | A | 4/2008 |
| JP | 2013/531739 | A | 8/2013 |
| WO | 2013/182177 | A1 | 12/2013 |

OTHER PUBLICATIONS

Gabb, T.P., et al., "γ' Formation in a Nickel-Base Disk Superalloy," NASA Glenn Research Center, pp. 405-414 (2000).

Invitation to Pay Additional Fees issued in connection with corresponding PCT Application No. PCT/US2015/045547 dated Apr. 29, 2016.

International Search Report and Written Opinion issued in connection with corresponding PCT Application No. PCT/US2015/045547 dated Jul. 5, 2016.

International Preliminary Report on Patentability issued in connection with corresponding PCT Application No. PCT/US2015/045547 dated Feb. 21, 2017.

Tsai, Y.L., et al., "Effects of Zr Addition on the microstructure and mechanical behavior of a fine-grained nickel-based superalloy at elevated temieratures," Materials Science and Engineering: A, vol. 607, p. 2 (Jun. 23, 2014) (Abstract).

Machine Translation and First Office Action and Search issued in connection with corresponding CN Application No. 201580044338.X dated Jan. 9, 2018.

Tsai et al., Effects of Zr Addition on the Microstructure and Mechanical Behavior of a Fine-Grained Nickel-Based Superalloy at Elevated Temperatures, ScienceDirect, Materials Science & Engineering, 607, 2014, pp. 294-301.

Machine Translated Japanese Search Report Corresponding to Application No. 2017507957 dated Jun. 13, 2019.

Machine Translated Japanese Office Action Corresponding to Application No. 2017507957 dated Jul. 29, 2019.

* cited by examiner

ENHANCED SUPERALLOYS BY ZIRCONIUM ADDITION

TECHNICAL FIELD

Embodiments of the present invention generally relate to nickel-base alloy compositions, and more particularly to nickel-base superalloys suitable for components, for example, turbine disks of gas turbine engines that require a polycrystalline microstructure and a combination of disparate properties such as creep resistance, tensile strength, and high temperature dwell capability.

BACKGROUND

The turbine section of a gas turbine engine is located downstream of a combustor section and contains a rotor shaft and one or more turbine stages, each having a turbine disk (rotor) mounted or otherwise carried by the shaft and turbine blades mounted to and radially extending from the periphery of the disk. Components within the combustor and turbine sections are often formed of superalloy materials in order to achieve acceptable mechanical properties while at elevated temperatures resulting from the hot combustion gases. Higher compressor exit temperatures in modern high pressure ratio gas turbine engines can also necessitate the use of high performance nickel superalloys for compressor disks, blisks, and other components. Suitable alloy compositions and microstructures for a given component are dependent on the particular temperatures, stresses, and other conditions to which the component is subjected. For example, airfoil components such as blades and vanes are often formed of equiaxed, directionally solidified (DS), or single crystal (SX) superalloys, whereas turbine disks are typically formed of superalloys that must undergo carefully controlled forging, heat treatments, and surface treatments such as peening to produce a polycrystalline microstructure having a controlled grain structure and desirable mechanical properties.

Turbine disks are often formed of gamma prime (γ') precipitation-strengthened nickel-base superalloys (hereinafter, gamma prime nickel-base superalloys) containing chromium, tungsten, molybdenum, rhenium and/or cobalt as principal elements that combine with nickel to form the gamma (γ) matrix, and contain aluminum, titanium, tantalum, niobium, and/or vanadium as principal elements that combine with nickel to form the desirable gamma prime precipitate strengthening phase, principally $Ni_3(Al,Ti)$. Gamma prime precipitates are typically spheroidal or cuboidal, though a cellular form may also occur. However, as reported in U.S. Pat. No. 7,740,724, cellular gamma prime is typically considered undesirable due to its detrimental effect on creep-rupture life. Particularly notable gamma prime nickel-base superalloys include Rene 88DT (R88DT; U.S. Pat. No. 4,957,567) and Rene 104 (R104; U.S. Pat. No. 6,521,175), as well as certain nickel-base superalloys commercially available under the trademarks Inconel®, Nimonic®, and Udimet®. R88DT has a composition of, by weight, about 15.0-17.0% chromium, about 12.0-14.0% cobalt, about 3.5-4.5% molybdenum, about 3.5-4.5% tungsten, about 1.5-2.5% aluminum, about 3.2-4.2% titanium, about 0.5.0-1.0% niobium, about 0.010-0.060% carbon, about 0.010-0.060% zirconium, about 0.010-0.040% boron, about 0.0-0.3% hafnium, about 0.0-0.01 vanadium, and about 0.0-0.01 yttrium, the balance nickel and incidental impurities. R104 has a composition of, by weight, about 16.0-22.4% cobalt, about 6.6-14.3% chromium, about 2.6-4.8% aluminum, about 2.4-4.6% titanium, about 1.4-3.5% tantalum, about 0.9-3.0% niobium, about 1.9-4.0% tungsten, about 1.9-3.9% molybdenum, about 0.0-2.5% rhenium, about 0.02-0.10% carbon, about 0.02-0.10% boron, about 0.03-0.10% zirconium, the balance nickel and incidental impurities.

Disks and other critical gas turbine engine components are often forged from billets produced by powder metallurgy (P/M), conventional cast and wrought processing, and spraycast or nucleated casting forming techniques. While any suitable method may be used, gamma prime nickel-base superalloys formed by powder metallurgy are particularly capable of providing a good balance of creep, tensile, and fatigue crack growth properties to meet the performance requirements of turbine disks and certain other gas turbine engine components. In a typical powder metallurgy process, a powder of the desired superalloy undergoes consolidation, such as by hot isostatic pressing (HIP) and/or extrusion consolidation. The resulting billet is then isothermally forged at temperatures slightly below the gamma prime solvus temperature of the alloy to approach superplastic forming conditions, which allows the filling of the die cavity through the accumulation of high geometric strains without the accumulation of significant metallurgical strains. These processing steps are designed to retain the fine grain size originally within the billet (for example, ASTM 10 to 13 or finer), achieve high plasticity to fill near-net-shape forging dies, avoid fracture during forging, and maintain relatively low forging and die stresses. In order to improve fatigue crack growth resistance and mechanical properties at elevated temperatures, these alloys are then often heat treated above their gamma prime solvus temperature (generally referred to as a solution heat treatment or supersolvus heat treatment) to solution precipitates and cause significant, uniform coarsening of the grains.

In many gamma prime nickel-based superalloys, hafnium (Hf) is included within a specified range of the superalloy composition as a strengthening element. For example, the gamma prime nickel-based superalloy described in U.S. Pat. No. 8,613,810 of Mourer, et al. includes 0.05 wt % to 0.6 wt % hafnium. It is believed that higher Hf levels tend to promote fan gamma prime at grain boundaries creating a desirable interlocking grain structure. Even with these benefits of hafnium within the superalloy composition, the relatively high cost of hafnium restricts is use in many applications. Additionally, hafnium is reactive with certain crucible materials, which further limits its use.

Also in many gamma prime nickel-based superalloys, zirconium (Zr) is included within a specified range of the superalloy composition, as it is attributed the high temperature property variability. In particular, it is commonly believed that adding B and Zr together (at about 0.01% each) provides even better rupture, ductility and workability. However, the use of zirconium (Zr) in gamma prime nickel-based superalloys has been limited because Zr has earned the reputation as a "bad actor" in the field of gas turbine components. Primarily, Zr has been associated with increased porosity, especially in integral wheel castings, and hot tearing. Higher Zr is also believed to lower the incipient melting temperature and increase the eutectic constituent in castings or ingots. Use of powder metallurgy processing alleviates these porosity and eutectic concerns.

BRIEF DESCRIPTION

Aspects and advantages of the invention will be set forth in part in the following description, or may be obvious from the description, or may be learned through practice of the embodiments of the invention.

A Hf-containing, gamma prime nickel-based superalloy is generally provided, along with its methods of manufacture. In one embodiment, the Hf-containing, gamma prime nickel-based superalloy includes: about 10 wt % to about 22 wt % cobalt; about 9 wt % to about 14 wt % chromium; 0 wt % to about 10 wt % tantalum; about 2 wt % to about 6 wt % aluminum; about 2 wt % to about 6 wt % titanium; about 1.5 wt % to about 6 wt % tungsten; about 1.5 wt % to about 5.5 wt % molybdenum; 0 wt % to about 3.5 wt % niobium; about 0.01 wt % to about 1.0 wt % hafnium; about 0.02 wt % to about 0.1 wt % carbon; about 0.01 wt % to about 0.4 wt % boron; about 0.15 wt % to about 1.3 wt % zirconium; and the balance nickel and impurities. In a particular embodiment, the total amount of hafnium and zirconium in the gamma prime nickel-based superalloy is about 0.3 wt % to about 1.5 wt %.

A gamma prime nickel-based superalloy is also generally provided, along with its methods of manufacture. In one embodiment, the gamma prime nickel-based superalloy includes: 0 wt % to about 21 wt % cobalt; about 10 wt % to about 30 wt % chromium; 0 wt % to about 4 wt % tantalum; 0.1 wt % to about 5 wt % aluminum; 0.1 wt % to about 10 wt % titanium; 0 wt % to about 14 wt % tungsten; 0 wt % to about 15 wt % molybdenum; 0 wt % to about 40 wt % iron; 0 wt % to about 1 wt % manganese; 0 wt % to about 1 wt % silicon; 0 wt % to about 5 wt % niobium; 0 wt % to about 0.01 wt % hafnium; 0 wt % to about 0.35 wt % carbon; 0 wt % to about 0.35 wt % boron; about 0.25 wt % to about 1.3 wt % zirconium; and the balance nickel and impurities, wherein the gamma prime nickel-based superalloy includes at least 4 wt % of a combined amount of aluminum and titanium, and wherein the gamma prime nickel-based superalloy includes tungsten, niobium, or a mixture thereof. In certain embodiment, the gamma prime nickel-based superalloy includes 0 wt % to about 0.008 wt % hafnium, and may be free from hafnium.

A gamma prime nickel-based superalloy is also provided, which includes a combination of Ti and Zr in a total weight amount sufficient to form cellular precipitates located at grain boundaries of the alloy, wherein the cellular precipitates define gamma prime arms that distort the grain boundaries at which they are located.

The Hf-containing, gamma prime nickel-based superalloy and/or the gamma prime nickel-based superalloy according to any embodiment disclosed herein includes, in certain embodiments, cellular precipitates that are predominantly located at grain boundaries of the alloy such that the cellular precipitates define gamma prime arms that distort the grain boundaries at which they are located. The superalloys can further include finer gamma prime precipitates (e.g., cuboidal or spherical precipitates) than the cellular precipitates. For example, the alloy can contain about 5 to about 12 volume percent of the cellular precipitates and/or about 43 to about 50 volume percent of the finer gamma prime precipitates.

A rotating component (e.g., a turbine disk or a compressor disk) of a gas turbine engine is also provided, with the rotating component being formed of the Hf-containing, gamma prime nickel-based superalloy and/or the gamma prime nickel-based superalloy according to any embodiment disclosed herein.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

The subject matter which is regarded as the invention is particularly pointed out and distinctly claimed in the concluding part of the specification. The embodiments of the invention, however, may be best understood by reference to the following description taken in conjunction with the accompanying drawing figures in which:

DETAILED DESCRIPTION

Figure 1:
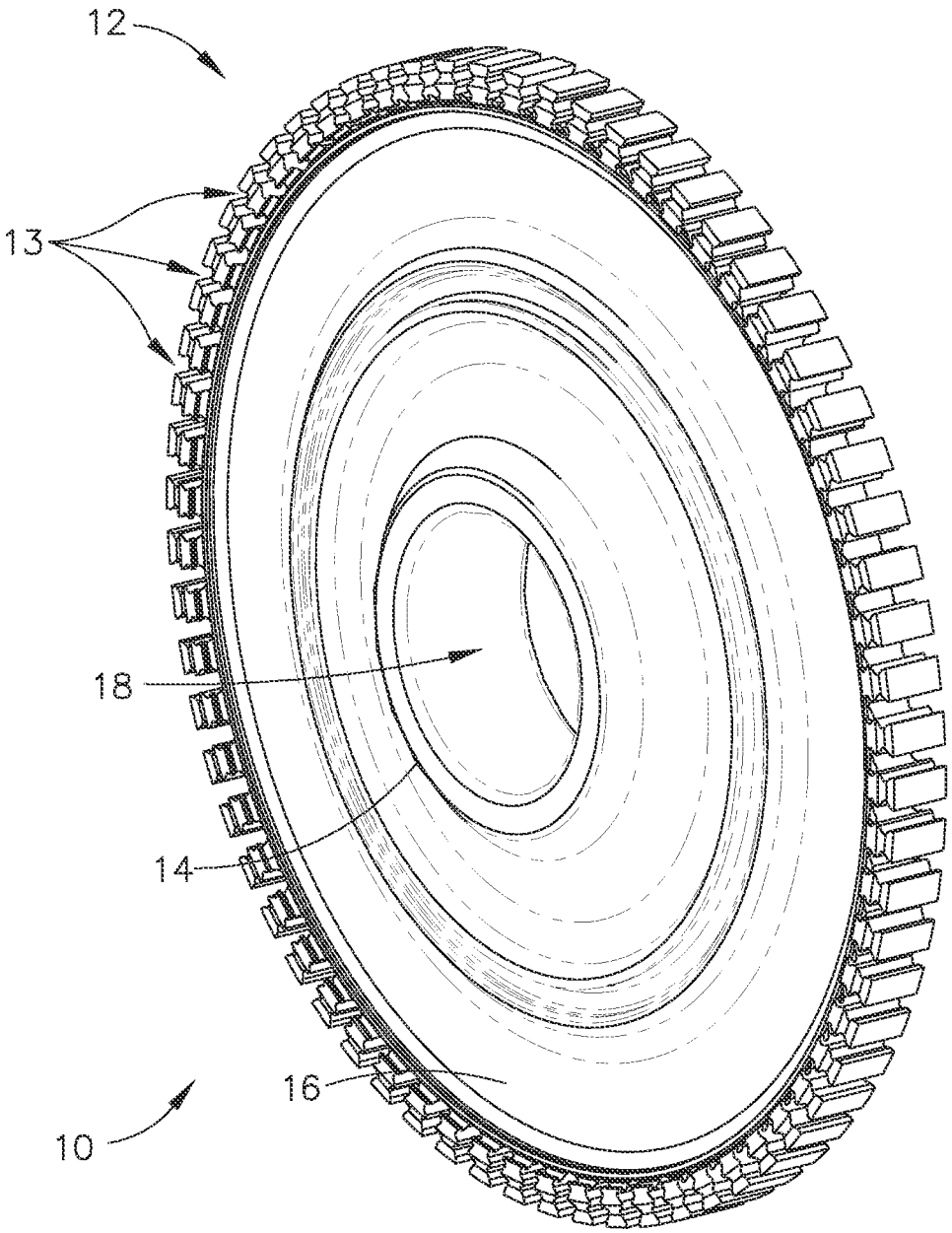
FIG. 1 is a perspective view of an exemplary turbine disk of a type used in gas turbine engines according to an embodiment of the invention.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Gamma prime nickel-base superalloys are generally provided that are particularly suitable for components produced by a hot working (e.g., forging) operation to have a polycrystalline microstructure. A particular example of such a component is represented in FIG. 1 as a high pressure turbine disk 10 for a gas turbine engine. Embodiments of the invention will be discussed in reference to processing of the disk 10, though those skilled in the art will appreciate that the teachings and benefits of the embodiments are also applicable to compressor disks and blisks of gas turbine engines, as well as other components that are subjected to stresses at high temperatures and therefore require a high temperature superalloy.

The disk 10 represented in FIG. 1 generally includes an outer rim 12, a central hub or bore 14, and a web 16 between the rim 12 and bore 14. The rim 12 is configured for the attachment of turbine blades (not shown) by including dovetail slots 13 along the disk outer periphery into which the turbine blades are inserted. A bore hole 18 in the form of a through-hole is centrally located in the bore 14 for mounting the disk 10 on a shaft, and therefore the axis of the bore hole 18 coincides with the axis of rotation of the disk 10. The disk 10 is a unitary forging and representative of turbine disks used in aircraft engines, including but not limited to high-bypass gas turbine engines, such as those manufactured by the General Electric Company.

Disks of the type represented in FIG. 1 are typically produced by isothermally forging a fine-grained billet formed by powder metallurgy (PM), a cast and wrought processing, or a spraycast or nucleated casting type technique. In a particular embodiment utilizing a powder metallurgy process, the billet can be formed by consolidating a superalloy powder, such as by hot isostatic pressing (HIP) or extrusion consolidation. The billet is typically forged under superplastic forming conditions at a temperature at or near the recrystallization temperature of the alloy but less than the gamma prime solvus temperature of the alloy. After forging, a supersolvus (solution) heat treatment is performed, during which grain growth occurs. The supersolvus heat treatment is performed at a temperature above the gamma prime solvus temperature (but below the incipient melting temperature) of the superalloy to recrystallize the worked grain structure and dissolve (solution) the gamma prime precipitates (principally $(Ni, Co)_3(Al,Ti)$) in the superalloy. Following the supersolvus heat treatment, the component is cooled at an appropriate rate to re-precipitate gamma prime within the gamma matrix or at grain boundaries, so as to achieve the particular mechanical properties desired. The component may also undergo aging using known techniques.

Because the bore 14 and web 16 of the turbine disk 10 have lower operating temperatures than the rim 12, different properties are needed in the rim 12 and bore 14, in which case different microstructures may also be optimal for the rim 12 and bore 14. Typically, a relatively fine grain size is optimal for the bore 14 and web 16 to promote tensile strength, burst strength, and resistance to low cycle fatigue (LCF), while a coarser grain size is more optimal in the rim 12 to promote creep, stress-rupture, and dwell LCF, and dwell fatigue crack growth resistance at high temperatures. Also, grain boundary character becomes more important as operating temperatures increase and grain boundary failure modes become the limiting behaviors. This trend toward grain boundary-driven behavior being the limiting factor has led to the use of supersolvus coarse grain processing, in part, to provide a more tortuous grain boundary failure path that promotes improvements in high temperature behavior. Thus grain boundary factors, including the degree to which grain boundaries are serrated to increase the tortuosity of potential grain boundary failure paths, are even more important in a disk rim.

As discussed previously, higher operating temperatures associated with more advanced engines have placed greater demands on turbine disks, and particularly on the creep and dwell crack growth characteristics of turbine disk rims. While dwell fatigue crack growth resistance within the rim 12 can be improved by avoiding excessively high cooling rates or reducing the cooling rate or quench following the solution heat treatment, such improvements are typically obtained at the expense of creep properties within the rim 12. Furthermore, because the disk rim 12 is typically thinner with a reduced cross-section, specific attention must be given to maintain a lower cooling rate, which adds complexity to the disk heat treatment schedule and any cooling rate procedures, fixturing or apparatus.

Figure 3:
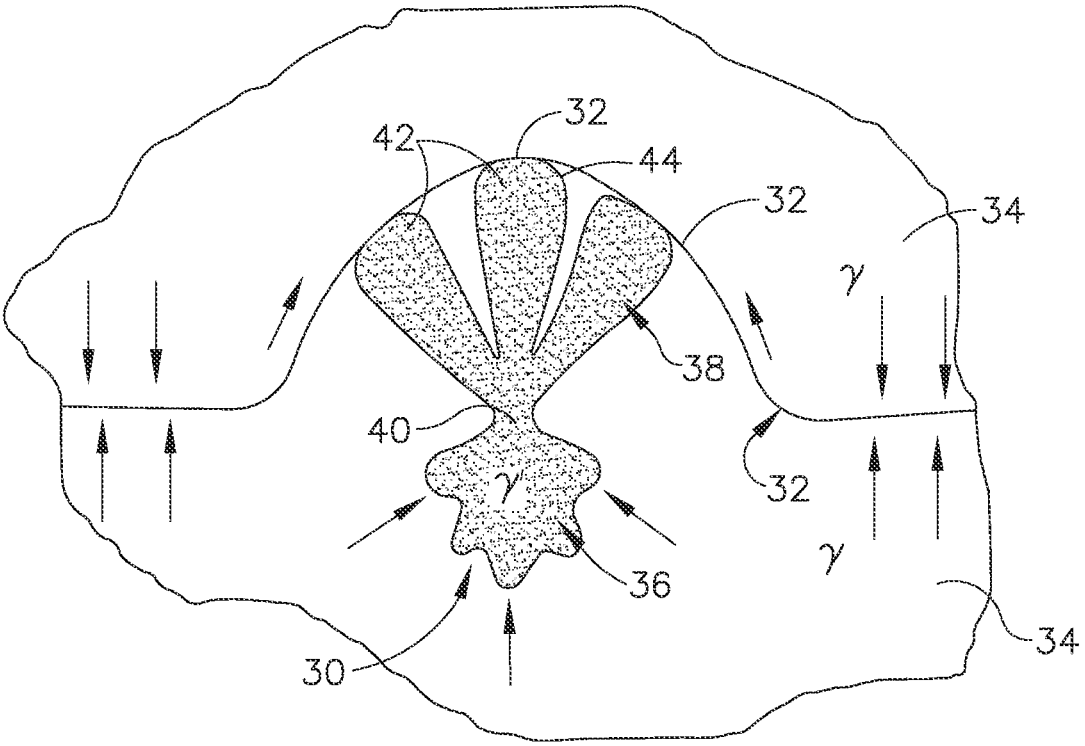
FIG. 3 is a schematic representation of a cellular gamma prime precipitate of a superalloy composition.

Generally, the gamma prime nickel-based superalloy is processed, including a solution heat treatment and quench, to have a microstructure that contains cellular precipitates of gamma prime. A cellular precipitate 30 is schematically represented in FIG. 3. In FIG. 3, the cellular precipitate is represented as having a fan-like structure comprising multiple arms radiating from a common and much smaller origin. In particular embodiments, the cellular precipitate is surrounded by considerably smaller (finer) gamma prime precipitates, which are interspersed between the larger arms of the cellular precipitate as well as generally dispersed throughout the grain interior. Compared to the cellular precipitate, the smaller gamma prime precipitates are more discrete and typically cuboidal or spherical, generally of the type, shape and size typically found in gamma-prime precipitation-strengthened nickel-base superalloys. The volume fraction of the smaller gamma prime precipitates is greater than that of the cellular precipitates, and typically in a range of about 43 to about 50 volume percent.

The term "cellular" is used herein in a manner consistent within the art, namely, to refer to a colony of the gamma prime phase that grows out towards a grain boundary in a manner that causes the phase to have the appearance of an organic cell. More particularly, growth of cellular precipitates of gamma prime is the result of a solid-state transformation in which the precipitates nucleate and grow as aligned colonies towards a grain boundary. While not wishing to be bound by any theory, it is surmised that during the post-solutioning quench, the supersaturated gamma matrix heterogeneously nucleates gamma prime, which grows in the fan structure morphology towards the grain boundary and distorts the grain boundary from its preferred low-energy minimum-curvature path.

The cellular precipitate 30 represented in FIG. 3 is shown as located at a boundary 32 between two grains 34 of the polycrystalline microstructure of the superalloy. The precipitate 30 has a base portion 36 and a fan-shaped portion 38 that extends from a central location or locus point 40 in a direction away from a general origin locus, which may include a base portion 36. Notably, the fan-shaped portion 38 is much larger than the base portion 36 (if present). Furthermore, the fan-shaped portion 38 has multiple lobes or arms 42 that are large and well defined, resulting in the fan-shaped portion 38 having a convoluted border 44. While the arms 42 impart a fan-like appearance to the precipitate 30 when observed in two dimensions, the arms 42 confer a more cauliflower-type morphology when observed in their full three-dimensional nature.

FIG. 3 represents the arms 42 of the fan-shaped portion 38 as extending toward the local grain boundary 32 and distorting its preferred natural path, which is normally a low-energy minimum-curvature path. In the presence of a sufficient volume fraction of cellular precipitates represented in FIG. 3, for example, at least 5 volume percent such as about 5 to about 12 volume percent, the grain boundaries of the superalloy tend to have a serrated, convoluted or otherwise irregular shape, which in turn creates a tortuous grain boundary fracture path that is believed to promote the fatigue crack growth resistance of the superalloy. While not wishing to be bound by any particular theory, it is believed that the fan-shaped portions of the cellular gamma prime precipitates appear to be preferentially oriented towards the grain boundaries of the superalloy, and the broad fan regions are typically observed to intersect or coincide with the grain boundaries. The apparent growth of the fan-shaped portions is noted to distort the grain boundaries to the extent that the grain boundaries have a very irregular shape, frequently outlining the fan-shaped portions and creating a morphology that exhibits a degree of grain interlocking. Certain grain boundaries have been observed to have a morphology approaching a ball-and-socket arrangement, attesting to the high degree of grain boundary serration or tortuosity caused by the fan-shaped portions.

The gamma prime nickel-based superalloy forms, in particular embodiments, serrated or tortuous grain boundaries, promoted by the fan-shaped cellular precipitates of the type shown in FIG. 3, through the application of a solution heat treatment that solutions all gamma prime precipitates, followed by a cool down or quench at a rate that can be readily attained with conventional heat treatment equipment. Preferred solution heat treatments also do not require a complex heat treatment schedule, such as slow and controlled initial cooling rates and high temperature holds below the gamma prime solvus temperature, as has been previously required to promote serration formation. Furthermore, the serrated and tortuous grain boundaries produced in the superalloy using preferred heat treatments have been observed to have greater amplitude and a higher degree of apparent interlocking than has been produced by simple growth of gamma prime precipitates local to grain boundaries.

A particular example of a heat treatment follows the production of an article from the superalloy using a suitable forging (hot working) process. The superalloy forging is supersolvus solutioned at a temperature of about 2100° F. to 2175° F. (about 1150° C. to about 1190° C.) or higher, after which the entire forging can be cooled at a rate of about 50 to about 300° F./minute (about 30 to about 170° C./minute), more preferably at a rate of about 100 to about 200° F./minute (about 55 to about 110° C./minute). Cooling is performed directly from the supersolvus temperature to a temperature of about 1600° F. (about 870° C.) or less. Consequently, it is unnecessary to perform heat treatments that involve multiple different cool rates, high temperature holds, and/or slower quenches to promote the grain boundaries to have a serrated, convoluted or otherwise irregular shape, which in turn creates a tortuous grain boundary fracture path that is believed to promote the fatigue crack growth resistance of the superalloys.

Nickel-based superalloy is strengthened primarily by the $Ni_3Al$ γ' phase in the matrix. The Ni—Al phase diagram indicates that the $Ni_3Al$ phase has a broad range of potential chemical compositions. The broad range of chemical compositions implies that significant alloying of gamma prime is feasible. The Ni site in gamma prime is primarily occupied by Ni but the "Ni site" may in fact contain appreciable Co content. Focusing on the "Al site" location, Al atom replacement is possible by such atoms as Si, Ge, Ti, V, Hf, Zr, Mo, W, Ta, or Nb. A major factor in gamma prime alloying is the relative size/diameter of the element and its impact on distorting the gamma prime lattice and increasing the coherency strains. While they are potentially useful additions Si, Ge and V have factors which reduce their desirability for gamma prime alloying. Molybdenum and tungsten have limited solubility for X in $Ni_3X$, and their effect on the mismatch due to change in the lattice parameter of $Ni_3X$ would not be appreciable. Focusing on gamma prime alloying by Ti, Hf, Zr, Ta, or Nb, their increasing effectiveness based solely on increasing diameter and increasing refractory nature re-orders them Ti, Nb/Ta and Zr/Hf (most desirable).

As such, Hf and Zr are highly effective strengthening elements in gamma prime nickel-based superalloys (e.g., $Ni_3Al$), because of the relatively large size of the atoms along with the difference between the valence of these atoms, the APB energy, and the energy associated with cross-slip on the (100) face. It is believed that both Hf and Zr increase the CRSS (critical resolved shear stress) on the (100) face and only weakly affect the (111) face. Thus, the temperature of transfer of slip systems is increased. Additionally, both Hf and Zr reduce the APB energy, increasing the rate of the cross-slip from {111} to {100} associated with super-dislocation. Additionally, it is presently believed that higher Hf levels tend to promote fan gamma prime at grain boundaries creating a desirable interlocking grain structure, such as shown in FIG. 3, and it is believed that the Ti/Zr/Hf levels and relative amounts are critical factors in fan gamma prime formation.

Based on its position in the periodic table including its atomic diameter, Zr is believed to provide similar effects as Hf on enhancing fan gamma prime at grain boundaries with improvements in high temperature behavior consistent with a highly tortuous grain boundary path and interlocking grain structures. The use of Zr instead of Hf has potential advantages in both cost and inclusion content. Additionally, Zr tends to fill lattice discontinuities at interface boundaries or grain boundaries, increasing the structural regularity and the strength of bonds between the angulated lattices. This interface segregation and vacancy filling would also serve to reduce or impede grain boundary diffusion of such species such as oxygen and sulfur, major factors in high temperature behavior. Thus, enhanced Zr levels may further enrich at grain boundaries and boride/matrix interfaces, and become solid solution in the MC carbide and matrix, possibly changing the primary MC carbide and influencing the gamma prime morphology as well.

Thus, the addition of Zr may fill grain boundary vacancies resulting in improvement of the grain boundary structure by reducing vacancy density and increasing bond strength between the GBs. A general mechanism is that odd-size atoms (~20-30% oversize or undersize) segregate at grain boundaries, filling vacancies and reducing grain boundary diffusion. When Zr concentrates at the grain boundary and fills grain boundary micro-cavities, this reduces grain boundary stress concentrations, retarding crack initiation and propagation, and increasing the rupture life and elongation. Additionally, zirconium has been found to form $Zr_4C_2S_2$, significantly reducing the amount of elemental sulfur at the grain boundaries and retarding the generation of grain boundary cracking. These tendencies promote the accommodation of stress improving ductility and retarding the initiation and propagation of cracks, increasing the high temperature strength and dwell resistance of the alloy.

Notwithstanding the benefits of Zr, Zr has been used at the 0.05 wt. % nominal levels in wrought superalloys, with some alloys at up to 0.10 wt. %. However, higher Zr enrichment levels (e.g., about 0.15 wt % to about 1.3 wt %, such as 0.2 wt % to about 0.4 wt %) have the potential for further improvements, particularly as a replacement for Hf or augmenting a Hf addition.

Since it is believed that that the Ti/Zr/Hf levels and relative amounts are critical factors in fan gamma prime formation, the following discussion is directed to two types of gamma prime nickel-based superalloys: (1) Hf-containing gamma prime nickel-based superalloys and (2) gamma prime nickel-based superalloys free from Hf or containing no more than a nominal amount of Hf (e.g., up to 0.01 wt %).

In one embodiment, Hf-containing, gamma prime nickel-based superalloys are generally provided that comprise: about 10 wt % to about 25 wt % cobalt (e.g., about 17 wt % to about 21 wt % cobalt); about 9 wt % to about 14 wt % chromium (e.g., about 10.5 wt % to about 13 wt % chromium); 0 wt % to about 10 wt % tantalum (e.g., about 4.6 wt % to about 5.6 wt % tantalum); about 2 wt % to about 6 wt % aluminum (e.g., about 2.6 wt % to about 3.8 wt % aluminum); about 2 wt % to about 6 wt % titanium (e.g., about 2.5 wt % to about 3.7 wt % titanium); about 1.5 wt % to about 6 wt % tungsten (e.g., about 2.5 wt % to about 4.5 wt % tungsten); about 1.5 wt % to about 5.5 wt % molybdenum (e.g., about 2 wt % to about 5 wt % molybdenum); 0 wt % to about 3.5 wt % niobium (e.g., about 1.3 wt % to about 3.2 wt % niobium); about 0.01 wt % to about 1.0 wt % hafnium (e.g., about 0.3 wt % to about 0.8 wt % hafnium); about 0.02 wt % to about 0.1 wt % carbon (e.g., about 0.03 wt % to about 0.08 wt % carbon); about 0.01 wt % to about 0.4 wt % boron (e.g., about 0.02 wt % to about 0.04 wt % boron); about 0.15 wt % to about 1.3 wt % zirconium (e.g., about 0.25 wt % to about 1.0 wt % zirconium, such as about 0.25 wt % to about 0.55 wt %); and the balance nickel and impurities.

The compositional ranges set forth above are summarized in Table 1 below, which are expressed in weight percent (wt %):

TABLE 1

| Component | Broad (wt %) | Preferred (wt %) | Exemplary (wt %) |
|---|---|---|---|
| Co | 10.0-25.0 | 17.0-21.0 | 20.0 |
| Cr | 9.0-14.0 | 10.5-13.0 | 11.0 |
| Ta | up to 10.0 | 4.6-5.6 | 5.0 |
| Al | 2.0-6.0 | 2.6-3.8 | 3.2 |
| Ti | 2.0-6.0 | 2.5-3.7 | 2.7 |
| W | 1.5-6.0 | 2.5-4.5 | 4.3 |
| Mo | 1.5-5.5 | 2.0-5.0 | 2.5 |
| Nb | up to 3.5 | 1.3-3.2 | 2.0 |
| Hf | 0.01-1.0 | 0.3-0.8 | 0.5 |
| C | 0.02-0.10 | 0.03-0.08 | 0.058 |
| B | 0.01-0.4 | 0.02-0.04 | 0.03 |
| Zr | 0.15-1.3 | 0.25-0.55 | 0.25 |
| Ni | Balance | Balance | Balance |

According to an aspect of the invention, the superalloy described in Table 1 provides the potential for balanced improvements in high temperature dwell properties, including improvements in both creep and fatigue crack growth resistance at elevated temperatures, while limiting the negatives associated with the use of Hf.

While discussed above in Table 1 with respect to one particular gamma prime nickel-based superalloy, the substitution of Zr for Hf can be utilized in any gamma prime nickel-based superalloy that contains Hf. In this embodiment, both hafnium and zirconium are present in the gamma prime nickel-based superalloy, with the total amount of hafnium and zirconium (Hf+Zr) being about 0.3 wt % to about 1.5 wt %. For example, in such an embodiment, the amount of zirconium can be at least about 0.25 wt % of the gamma prime nickel-based superalloy (e.g., about 0.25 wt % to about 1.0 wt % zirconium, such as about 0.25 wt % to about 0.55 wt %), with at least some amount of hafnium present (e.g., about 0.01 wt % to about 1.0 wt %).

Referring to Table 2, the compositions of several commercially available, Hf-containing gamma prime nickel-based superalloys are given, which are expressed in weight percent (wt %):

TABLE 2

| Alloy Name | Ni | Al | Ti | Ta | Cr | Co | Mo | W | Nb | C | B | Zr | Hf |
|---|---|---|---|---|---|---|---|---|---|---|---|---|---|
| AF115LC | 55.380 | 3.8 | 3.9 | 0 | 10.5 | 15 | 2.8 | 5.9 | 1.8 | 0.05 | 0.02 | 0.05 | 0.8 |
| AF115 | 54.080 | 3.8 | 3.9 | 0 | 10.5 | 15 | 2.8 | 5.9 | 1.8 | 0.15 | 0.02 | 0.05 | 2 |
| EP741NP | 58.610 | 5.1 | 1.8 | 0 | 9 | 15.8 | 3.9 | 5.5 | 0 | 0.04 | <0.015 | <0.015 | 0.25 |
| Merl 76 | 54.755 | 5 | 4.3 | 0 | 12.4 | 18.5 | 3.2 | 0 | 1.4 | 0.025 | 0.02 | 0 | 0.4 |
| NR3 (Onera) | 60.681 | 3.65 | 5.5 | 0 | 11.8 | 14.65 | 3.3 | 0 | 0 | 0.024 | 0.013 | 0.052 | 0.33 |
| RR1000 | 54.850 | 3 | 3.8 | 1.75 | 14.75 | 16.5 | 4.75 | 0 | 0 | 0.0225 | 0.018 | 0.06 | 0.5 |
| SR3 | 60.525 | 2.6 | 4.9 | 0 | 13 | 12 | 5.1 | 0 | 1.6 | 0.03 | 0.015 | 0.03 | 0.2 |

The titanium:aluminum weight ratio of the alloy specified in Table 1 is believed to be important on the basis that higher titanium levels are generally beneficial for most mechanical properties, though higher aluminum levels promote alloy stability necessary for use at high temperatures. The molybdenum:molybdenum+tungsten weight ratio is also believed to be important, as this ratio indicates the refractory content for high temperature response and balances the refractory content of the gamma and the gamma prime phases. In addition, the amounts of titanium, tantalum and chromium (along with the other refractory elements) are balanced to avoid the formation of embrittling phases such as sigma phase or eta phase or other topologically close packed (TCP) phases, which are undesirable and in large amounts will reduce alloy capability. Aside from the elements listed in Table 1, it is believed that minor amounts of other alloying constituents could be present without resulting in undesirable properties. Such constituents and their amounts (by weight) include up to 2.5% rhenium, up to 2% vanadium, up to 2% iron, and/or up to 0.1% magnesium.

As stated, the concentration of Zr in each of these Hf-containing gamma prime nickel-based superalloys can be increased to be about 0.15 wt % to about 1.3 wt %, such as about 0.25 wt % to about 0.55 wt %, while decreasing the Hf concentration.

However, many alloys allow for Hf as a constituent while not formally identifying it as part of the alloy composition. In these alloys, the concentration of Hf is typically present in a nominal amount, if at all. That is, such alloys include 0 wt % (i.e., free from Hf) to about 0.01 wt % (i.e., nominal amount of Hf present). Thus, an alternative embodiment is directed to nominally Hf-containing and/or Hf-free gamma prime nickel-based superalloys. In these nominally Hf-containing and/or Hf-free gamma prime nickel-based superalloys, the Zr concentration is of about 0.15 wt % to about 1.3 wt %, such as about 0.25 wt % to about 0.55 wt %, while further minimizing the need for Hf, if any, to be present and still realizing improved creep resistance, tensile strength, and high temperature dwell capability. The alloy so modified may exhibit the grain boundaries of the superalloy to have an enhanced serrated, convoluted or otherwise irregular shape, which in turn creates a tortuous grain boundary fracture path that is believed to promote the fatigue crack growth resistance of the superalloy.

For example, in such an embodiment, the amount of zirconium can be at least about 0.15 wt % of the gamma prime nickel-based superalloy (e.g., about 0.25 wt % to about 1.3 wt % zirconium, such as about 0.25 wt % to about 0.55 wt %), with the amount of hafnium completely absent or nominally present (e.g., about 0.001 wt % to about 0.1 wt %, such as about 0.01 wt % to about 0.08 wt %) within the gamma prime nickel-based superalloy. Additionally, to qualify as a high strength, gamma prime nickel-based superalloy, the alloy composition includes at least about 4 wt % of a combined amount of Al and Ti (e.g., about 4 wt % to about 15 wt %), along with at least one of tungsten or niobium, or both.

Thus, in one embodiment, a gamma prime nickel-based superalloy is generally provided that includes 0 wt % to about 0.01 wt % Hf, at least about 4 wt % of a combined amount of Al and Ti (e.g., about 4 wt % to about 15 wt %), at least one of W or Nb, and about 0.15 wt % to about 1.3 wt % zirconium, such as about 0.25 wt % to about 0.55 wt % zirconium. Such gamma prime nickel-based superalloys comprise: about 0 wt % to about 21 wt % cobalt (e.g., about 1 wt % to about 20 wt % cobalt); about 10 wt % to about 30 wt % chromium (e.g., about 10 wt % to about 20 wt % chromium); 0 wt % to about 4 wt % tantalum (e.g., 0 wt % to about 2.5 wt % tantalum); 0.1 wt % to about 5 wt % aluminum (e.g., about 1 wt % to about 4 wt % aluminum); 0.1 wt % to about 10 wt % titanium (e.g., about 0.2 wt % to about 5 wt % titanium); 0 wt % to about 14 wt % tungsten (e.g., about 1 wt % to about 6.5 wt % tungsten); 0 wt % to about 15 wt % molybdenum (e.g., about 1 wt % to about 10 wt % molybdenum); 0 wt % to about 40 wt % iron (e.g., 0 wt % to about 15 wt % iron); 0 wt % to about 1 wt % manganese (e.g., 0 wt % to about 0.5 wt % manganese); 0 wt % to about 1 wt % silicon (e.g., 0 wt % to about 0.5 wt % silicon); 0 wt % to about 5 wt % niobium (e.g., 0 wt % to about 3.6 wt % niobium); 0 wt % to about 0.01 wt % hafnium (e.g., 0 wt % to about 0.005 wt % hafnium); 0 wt % to about 0.35 wt % carbon (e.g., about 0.01 wt % to about 0.1 wt % carbon); 0 wt % to about 0.35 wt % boron (e.g., about 0.01 wt % to about 0.01 wt % boron); about 0.15 wt % to about 1.3 wt % zirconium (e.g., about 0.25 wt % to about 1.0 wt % zirconium, such as about 0.25 wt % to about 0.55 wt %); and the balance nickel and impurities.

The compositional ranges set forth above are summarized in Table 3 below, which are expressed in weight percent (wt %):

TABLE 3

| Component | Broad (wt %) | Preferred (wt %) |
|---|---|---|
| Co | 0-21.0 | 1-20 |
| Cr | 10-30 | 10-20 |
| Ta | 0-4 | 0-2.5 |
| Al | 0.1-5.0 | 1-4 |
| Ti | 0.1-10 | 0.2-5 |
| W | 0-14 | 1-6.5 |
| Mo | 0-15 | 1-10 |
| Fe | 0-40 | 0-15 |
| Mn | 0-1 | 0-0.5 |
| Si | 0-1 | 0-0.5 |
| Nb | 0-5 | 0-3.6 |
| Hf | 0-0.01 | 0-0.005 |
| C | 0-0.35 | 0.01-0.1 |
| B | 0-0.35 | 0.01-0.1 |
| Zr | 0.15-1.3 | 0.25-0.55 |
| Ni | Balance | Balance |

Aside from the elements listed in Table 3, it is believed that minor amounts of other alloying constituents could be present without resulting in undesirable properties. Such constituents and their amounts (by weight) include up to 2.5% rhenium, up to 2% vanadium, up to 2% iron, and/or up to 0.1% magnesium. According to an aspect of the invention, the superalloy described in Table 3 provides the potential for balanced improvements in high temperature dwell properties, including improvements in both creep and fatigue crack growth resistance at elevated temperatures, while limiting the negatives associated with the use of Hf.

Table 4 shows compositions of several commercially available, Hf-free gamma prime nickel-based superalloys, which are expressed in weight percent (wt %):

TABLE 4

| Alloy Name | Ni | Al | Ti | Ta | Cr | Co | Mo | W | Nb | Fe | Mn | Si | C | B | Zr | Hf | Other |
|---|---|---|---|---|---|---|---|---|---|---|---|---|---|---|---|---|---|
| Alloy 10 | 55.37 | 3.7 | 3.8 | 0.9 | 10.2 | 15 | 2.8 | 6.2 | 1.9 | 0 | 0 | 0 | 0.03 | 0.03 | 0.07 | 0 | 0 |
| KM4 | 55.91 | 4 | 4 | 0 | 12 | 18 | 4 | 0 | 2 | 0 | 0 | 0 | 0.03 | 0.03 | 0.03 | 0 | 0 |
| LSHR | 49.59 | 3.5 | 3.5 | 1.6 | 12.5 | 20.7 | 2.7 | 4.3 | 1.5 | 0 | 0 | 0 | 0.03 | 0.03 | 0.05 | 0 | 0 |
| ME16 | 49.97 | 3.4 | 3.7 | 2.4 | 13 | 20.6 | 3.8 | 2.1 | 0.9 | 0 | 0 | 0 | 0.05 | 0.03 | 0.05 | 0 | 0 |
| NF3 | 53.79 | 3.6 | 3.6 | 2.5 | 10.5 | 18 | 2.9 | 3 | 2 | 0 | 0 | 0 | 0.03 | 0.03 | 0.05 | 0 | 0 |
| P/M U720 | 57.89 | 2.55 | 5.05 | 0 | 15.6 | 14.6 | 3 | 1.24 | 0 | 0 | 0 | 0 | 0.008 | 0.03 | 0.03 | 0 | 0 |
| Rene 104 | 50.97 | 3.5 | 4.5 | 2.25 | 13 | 18.5 | 3.85 | 1.75 | 1.625 | 0 | 0 | 0 | 0.0575 | 0 | 0 | 0 | 0 |
| Rene 88 | 68.46 | 2.1 | 3.7 | 0 | 16 | 1 | 4 | 4 | 0.7 | 0 | 0 | 0 | 0.03 | 0.015 | 0 | 0 | 0 |
| Rene 95 | 61.29 | 3.5 | 2.5 | 0 | 14 | 8 | 3.5 | 3.5 | 3.5 | 0 | 0 | 0 | 0.15 | 0.01 | 0.05 | 0 | 0 |
| Udimet 520 | 56.95 | 2 | 3 | 0 | 19 | 12 | 6 | 1 | 0 | 0 | 0 | 0 | 0.05 | 0.005 | 0 | 0 | 0 |
| Udimet 710 | 54.91 | 2.5 | 5 | 0 | 18 | 15 | 3 | 1.5 | 0 | 0 | 0 | 0 | 0.07 | 0.02 | 0 | 0 | 0 |
| Udimet 720 | 55.51 | 2.5 | 5 | 0 | 17.9 | 14.7 | 3 | 1.3 | 0 | 0 | 0 | 0 | 0.03 | 0.033 | 0.03 | 0 | 0 |
| Unitemp AF2-1DA | 58.44 | 4.6 | 3 | 1.5 | 12 | 10 | 3 | 6 | 0 | 1 | 0 | 0 | 0.35 | 0.014 | 0.1 | 0 | 0 |
| Unitemp AF2-1DA | 60.35 | 4 | 2.8 | 1.5 | 12 | 10 | 2.7 | 6.5 | 0 | 0 | 0 | 0 | 0.04 | 0.015 | 0.1 | 0 | 0 |

As stated, the concentration of Zr in each of these nominal-HF or Hf-free gamma prime nickel-based superalloys can be increased to be about 0.15 wt % to about 1.3 wt %, such as about 0.25 wt % to about 0.55 wt %, while nearly or completely eliminating any Hf in the alloy (i.e., less than about 0.01 wt %). Thus, each of the alloys shown in Table 4 can be modified to include about 0.25 wt % to about 1.3 wt % Zr, such as about 0.25 wt % to about 0.55 wt % Zr.

Figure 2:
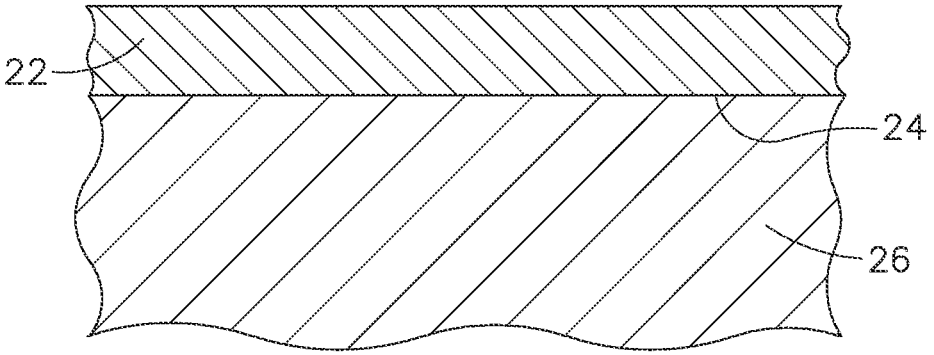
FIG. 2 schematically represents a cross-sectional view of a corrosion and oxidation-resistant coating on a superalloy substrate according to an embodiment of the invention.

In one embodiment, the superalloy component can have a corrosion-resistant coating thereon. Referring to FIG. 2, a corrosion-resistant coating 22 is shown deposited on a surface region 24 of a superalloy substrate 26. The superalloy substrate 26 may be the disk of FIG. 1, or any other component within a gas turbine engine.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A Hf-containing, gamma prime nickel-based superalloy, comprising:
about 10 wt % to about 22 wt % cobalt;
about 9 wt % to about 14 wt % chromium;
0 wt % to about 10 wt % tantalum;
about 2 wt % to about 6 wt % aluminum;
about 2 wt % to about 6 wt % titanium;
about 1.5 wt % to about 6 wt % tungsten;
about 1.5 wt % to about 5.5 wt % molybdenum;
1.3 wt % to 3.2 wt % niobium;
about 0.01 wt % to 0.8 wt % hafnium;
about 0.02 wt % to about 0.1 wt % carbon;
about 0.01 wt % to about 0.4 wt % boron;
about 0.15 wt % to about 1.3 wt % zirconium; and
the balance nickel and impurities.

2. The Hf-containing, gamma prime nickel-based superalloy as in claim 1, wherein the total amount of hafnium and zirconium in the gamma prime nickel-based superalloy is about 0.3 wt % to about 1.5 wt %.

3. The Hf-containing, gamma prime nickel-based superalloy as in claim 1, comprising about 0.3 wt % to 0.8 wt % hafnium.

4. The Hf-containing, gamma prime nickel-based superalloy as in claim 1, comprising about 0.25 wt % to about 0.55 wt % zirconium.

5. The Hf-containing, gamma prime nickel-based superalloy as in claim 1, comprising up to 2.5% rhenium, up to 2% vanadium, up to 2% iron, and/or up to 0.1% magnesium.

6. The Hf-containing, gamma prime nickel-based superalloy according to claim 1, wherein the alloy includes cellular precipitates that are predominantly located at grain boundaries of the alloy, and wherein the cellular precipitates define gamma prime arms that distort the grain boundaries at which they are located.

7. The Hf-containing, gamma prime nickel-based superalloy according to claim 6, wherein the alloy further includes finer gamma prime precipitates than the cellular precipitates, and wherein the finer gamma prime precipitates are cuboidal or spherical.

8. A rotating component of a gas turbine engine, the rotating component being formed of the Hf-containing, gamma prime nickel-based superalloy according to claim 1.

9. The rotating component according to claim 8, wherein the rotating component is a turbine disk or a compressor disk.

10. A Hf-containing, gamma prime nickel-based superalloy, comprising:
about 10 wt % to about 22 wt % cobalt;
about 9 wt % to about 14 wt % chromium;
0 wt % to about 10 wt % tantalum;
about 2 wt % to about 6 wt % aluminum;
about 2 wt % to about 6 wt % titanium;
about 1.5 wt % to about 6 wt % tungsten;
about 1.5 wt % to about 5.5 wt % molybdenum;
0 wt % to about 3.5 wt % niobium;
about 0.01 wt % to about 1.0 wt % hafnium;
about 0.02 wt % to about 0.1 wt % carbon;
about 0.01 wt % to about 0.4 wt % boron;
about 0.15 wt % to about 1.3 wt % zirconium; and
the balance nickel and impurities, wherein the alloy includes cellular precipitates that are predominantly located at grain boundaries of the alloy and includes finer gamma prime precipitates than the cellular precipitates, and wherein the cellular precipitates define gamma prime arms that distort the grain boundaries at which they are located, and wherein the finer gamma prime precipitates are cuboidal or spherical, and further wherein the alloy contains about 5 to about 12 volume percent of the cellular precipitates and/or about 43 to about 50 volume percent of the finer gamma prime precipitates.

11. A Hf-containing, gamma prime nickel-based superalloy, consisting of:
about 10 wt % to about 22 wt % cobalt;
about 9 wt % to about 14 wt % chromium;
4.6 wt % to about 5.6 wt % tantalum;
about 2 wt % to about 6 wt % aluminum;
about 2 wt % to about 6 wt % titanium;
about 1.5 wt % to about 6 wt % tungsten;
about 1.5 wt % to about 5.5 wt % molybdenum;
0 wt % to about 3.5 wt % niobium;
about 0.01 wt % to about 1.0 wt % hafnium;
about 0.02 wt % to about 0.1 wt % carbon;
about 0.01 wt % to about 0.4 wt % boron;
about 0.15 wt % to about 1.3 wt % zirconium; and
the balance nickel and impurities.

12. A gamma prime nickel-based superalloy, comprising:
0 wt % to about 21 wt % cobalt;
about 10 wt % to about 30 wt % chromium;
0 wt % to about 4 wt % tantalum;
0.1 wt % to about 5 wt % aluminum;
0.1 wt % to about 10 wt % titanium;
0 wt % to about 14 wt % tungsten;
0 wt % to about 15 wt % molybdenum;
0 wt % to about 40 wt % iron;
0 wt % to about 1 wt % manganese;
0 wt % to about 1 wt % silicon;
0 wt % to about 5 wt % niobium;
0 wt % to about 0.01 wt % hafnium;
0 wt % to about 0.35 wt % carbon;
0 wt % to about 0.35 wt % boron;
about 0.25 wt % to about 1.3 wt % zirconium; and
the balance nickel and impurities,
wherein the gamma prime nickel-based superalloy includes at least 4 wt % of a combined amount of aluminum and titanium, and wherein the gamma prime nickel-based superalloy includes tungsten, niobium, or a mixture thereof, wherein the alloy includes cellular precipitates that are predominantly located at grain boundaries of the alloy, and wherein the cellular precipitates define gamma prime arms that distort the grain boundaries at which they are located.

13. The gamma prime nickel-based superalloy as in claim 12, comprising 0 wt % to about 0.008 wt % hafnium.

14. The gamma prime nickel-based superalloy as in claim 12, wherein the gamma prime nickel-based supper alloy is free from hafnium.

15. The gamma prime nickel-based superalloy as in claim 12 comprising about 0.25 wt % to about 0.55 wt % zirconium.

16. The gamma prime nickel-based superalloy as in claim 12, comprising up to 2.5% rhenium, up to 2% vanadium, up to 2% iron, and/or up to 0.1% magnesium.

17. The gamma-prime nickel-base alloy according to claim 12, wherein the combined amount of aluminum and titanium present in the gamma-prime nickel-base alloy is about 4 wt % to about 15 wt %.

18. The gamma-prime nickel-base alloy according to claim 12, wherein the alloy further includes finer gamma prime precipitates than the cellular precipitates, and wherein the finer gamma prime precipitates are cuboidal or spherical.

19. The gamma-prime nickel-base alloy according to claim 18, wherein the alloy contains about 5 to about 12 volume percent of the cellular precipitates and/or about 43 to about 50 volume percent of the finer gamma prime precipitates.

20. A rotating component of a gas turbine engine, the rotating component being formed of the gamma-prime nickel-base alloy according to claim 12.

21. The rotating component according to claim 20, wherein the rotating component is a turbine disk or a compressor disk.

* * * * *